US007408301B2

(12) United States Patent
Kwon et al.

(10) Patent No.: US 7,408,301 B2
(45) Date of Patent: Aug. 5, 2008

(54) PLASMA DISPLAY PANEL

(75) Inventors: Jae-Ik Kwon, Suwon-si (KR); Won-Ju Yi, Suwon-si (KR); Kyoung-Doo Kang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 216 days.

(21) Appl. No.: 11/326,167

(22) Filed: Jan. 4, 2006

(65) Prior Publication Data

US 2006/0181209 A1 Aug. 17, 2006

(30) Foreign Application Priority Data

Feb. 16, 2005 (KR) ..... 10-2005-0012656

(51) Int. Cl.
*H01J 17/49* (2006.01)

(52) U.S. Cl. ..... 313/582; 313/586; 313/292; 313/485

(58) Field of Classification Search ..... 313/582–587, 313/485–487, 292, 238
See application file for complete search history.

(56) References Cited

U.S. PATENT DOCUMENTS

| | | | | |
|---|---|---|---|---|
| 5,744,909 | A * | 4/1998 | Amano | 313/585 |
| 6,864,631 | B1 * | 3/2005 | Wedding | 313/587 |
| 6,873,105 | B2 * | 3/2005 | Akiba | 313/586 |
| 2005/0116646 | A1 * | 6/2005 | Yoo et al. | 313/582 |
| 2006/0152157 | A1 * | 7/2006 | Jung et al. | 313/582 |

* cited by examiner

*Primary Examiner*—Joseph L. Williams
*Assistant Examiner*—Kevin Quarterman
(74) *Attorney, Agent, or Firm*—Christie, Parker & Hale, LLP

(57) ABSTRACT

A plasma display panel includes first and second substrates that face each other, a barrier rib structure that is disposed between the first and second substrates to divide a plurality of discharge cells, first and second electrodes that are formed to surround the discharge cells and that extend in a first direction. The first and second electrodes are buried in the barrier rib structure. Address electrodes are formed in a second direction crossing the first direction to correspond to the respective discharge cells, and phosphor layers are formed in the respective discharge cells, such that the discharge cells are divided into red, green, blue, and white discharge cells.

21 Claims, 12 Drawing Sheets

PLASMA DISPLAY PANEL

CROSS REFERENCE TO RELATED APPLICATION

This application claims priority to and the benefit of Korean Patent Application No. 10-2005-0012656, filed on Feb. 16, 2005, the entire content of which is incorporated herein by reference.

BACKGROUND OF THE INVENTION

1. Technical Field

The present invention relates to a plasma display panel that displays images using gas discharge, and more particularly, to a plasma display panel having an improved display electrode structure.

2. Related Art

In recent years, devices that use a plasma display panel (hereinafter, referred to as a "PDP") have attracted attention as next-generation flat panel displays because of their simple manufacturing method and ease of large screen manufacturing, as compared to other flat panel displays. PDPs also have superior characteristics such as a large screen, high image quality, reduced thickness, light weight, and a wide viewing angle.

PDPs are divided into a direct current (DC) type, an alternating current (AC) type, and a hybrid type according to a discharge voltage to be applied. Further, PDPs are divided into an opposed discharge type and a surface discharge type according to a discharge structure.

The DC PDP has a structure in which all electrodes are exposed to a discharge space and electric charges travel directly between opposing electrodes. In the AC PDP, at least one electrode is coated with a dielectric and a discharge is performed with wall charges, instead of direct traveling of the electric charges between the opposing electrodes.

In the DC PDP, the electric charges travel directly between the opposing electrodes, and thus there is problem in that the electrodes are seriously damaged. For this reason, in recent years an AC PDP using AC, in particular a three-electrode surface discharge type of structure, has been generally adopted.

FIG. 1 shows such an AC three-electrode surface discharge PDP, which has a front substrate 200 and a rear substrate 300.

Formed on the rear substrate 300 are address electrodes 330 for selecting discharge cells to be turned on, a rear dielectric layer 350 in which the address electrodes 330 are buried, a barrier rib 370 for dividing discharge cells, and phosphor layers 390 that are coated on the wall surfaces of the barrier rib 370 and bottom surfaces of the discharge cells.

Provided on the front substrate 200 facing the rear substrate 300 are electrodes 220 and 230 for performing the sustain discharge of the selected discharge cells, a front dielectric layer 250 in which the electrodes 220 and 230 are buried, and a protective film 290.

In the related art PDP, a pair of electrodes 220 and 230 are provided at an upper side of each of the discharge cells. The electrodes 220 and 230 are made of transparent electrodes so as to not shield light from the discharge cells. However, the transparent electrodes have high resistance, which results in a problematic increase in discharge voltage.

For this reason, in order to reduce resistance of the transparent electrode, an electrode made of a nontransparent metal is used. In this case, however, there is a problem in that light does not pass through the metal electrode and thus an aperture ratio of the discharge cell is degraded.

In addition, the electrodes formed in such a manner are protected while being covered with the dielectric layer and the protective film. In this case, transmittance of light emitted from the discharge cells is drastically degraded due to the dielectric layer and the protective film.

Further, in the related art surface discharge type of PDP, the electrodes for generating the discharge are formed at the upper side of the discharge space, that is, an inner surface of the front substrate 200 through which light passes. Accordingly, the discharge is generated at the inner surface of the front substrate 200 and is diffused, and thus there is a problem in that luminous efficiency deteriorates.

In addition, in the related art surface discharge type of PDP, when it is used for a long time, there is a problem in that a permanent afterimage is generated due to ion sputtering of charged particles of a discharge gas to a phosphor layer by an electric field.

SUMMARY OF THE INVENTION

In one embodiment of the present invention, a plasma display panel has an improved display electrode structure, thereby drastically enhancing an aperture ratio and transmittance.

According to a first aspect of the invention, a plasma display panel includes first and second substrates that face each other, and a barrier rib structure disposed between the first and second substrates to divide a plurality of discharge cells. The plasma display panel also includes first and second electrodes formed to surround the discharge cells and extending in a first direction. The first and second electrodes are buried in the barrier rib structure. Address electrodes are formed in a second direction crossing the first direction and correspond to the respective discharge cells. Phosphor layers are formed in the respective discharge cells such that the discharge cells are divided into red, green, blue, and white discharge cells.

The red, green, blue, and white discharge cells may be arranged in a 2×2 matrix so as to define one pixel.

Further, the barrier rib structure may comprise a dielectric.

Further, cross-sections of the discharge cells may be geometrically point-symmetric around their centers. In one embodiment, cross-sections of the discharge cells have substantially rectangular shapes.

Further, in the plasma display panel according to the first aspect of the present invention, the first and second electrodes may be linearly disposed from the first substrate to the second substrate. The second electrodes may select which of the discharge cells are to be turned on, together with the address electrodes.

Further, the barrier rib structure may have a first barrier rib that is disposed on the first substrate and a second barrier rib that is disposed on the second substrate. The first and second electrodes may be buried in the first barrier rib. The phosphor layers may be formed on the second barrier rib.

Further, the barrier rib structure may have vertical barrier ribs that are formed in the second direction and horizontal barrier ribs that are formed in the first direction crossing the second direction. The first and second electrodes may comprise line electrodes that extend in the first direction to be buried in a pair of the horizontal barrier ribs, and connection electrodes that connect the line electrodes that are buried in the vertical barrier ribs.

Further, the address electrodes may be buried in the barrier rib structure. In this case, the second electrodes may select which of the discharge cells are to be turned on, together with the address electrodes, and the address electrodes may be disposed to be proximate to the second electrodes.

According to a second aspect of the present invention, a plasma display panel includes first and second substrates that face each other, a barrier rib structure disposed between the first and second substrates to divide a plurality of discharge cells, and first and second electrodes that are formed to surround the discharge cells and that respectively extend in a first direction and in a second direction crossing the first direction. In one embodiment, the first and second electrodes are linearly buried in the barrier rib structure, and phosphor layers are formed in the respective discharge cells, such that the discharge cells are divided into red, green, blue, and white discharge cells.

The barrier rib structure may comprise vertical barrier ribs that are formed in the second direction and horizontal barrier ribs that are formed in the first direction crossing the second direction. The first electrodes may have first line electrodes, that extend in the first direction and are buried in a pair of the horizontal barrier ribs, and first connection electrodes, that connect the first line electrodes and are buried in the vertical barrier ribs. The second electrodes may comprise second line electrodes, that extend in the second direction and are buried in a pair of the vertical barrier ribs, and second connection electrodes, that connect the second line electrodes and are buried in the horizontal barrier ribs.

BRIEF DESCRIPTION OF THE DRAWINGS

These and/or other aspects and features of the invention will become apparent and more readily appreciated from the following description of examples of embodiments, taken in conjunction with the accompanying drawings, in which.

DESCRIPTION OF THE EMBODIMENTS

Figure 1:
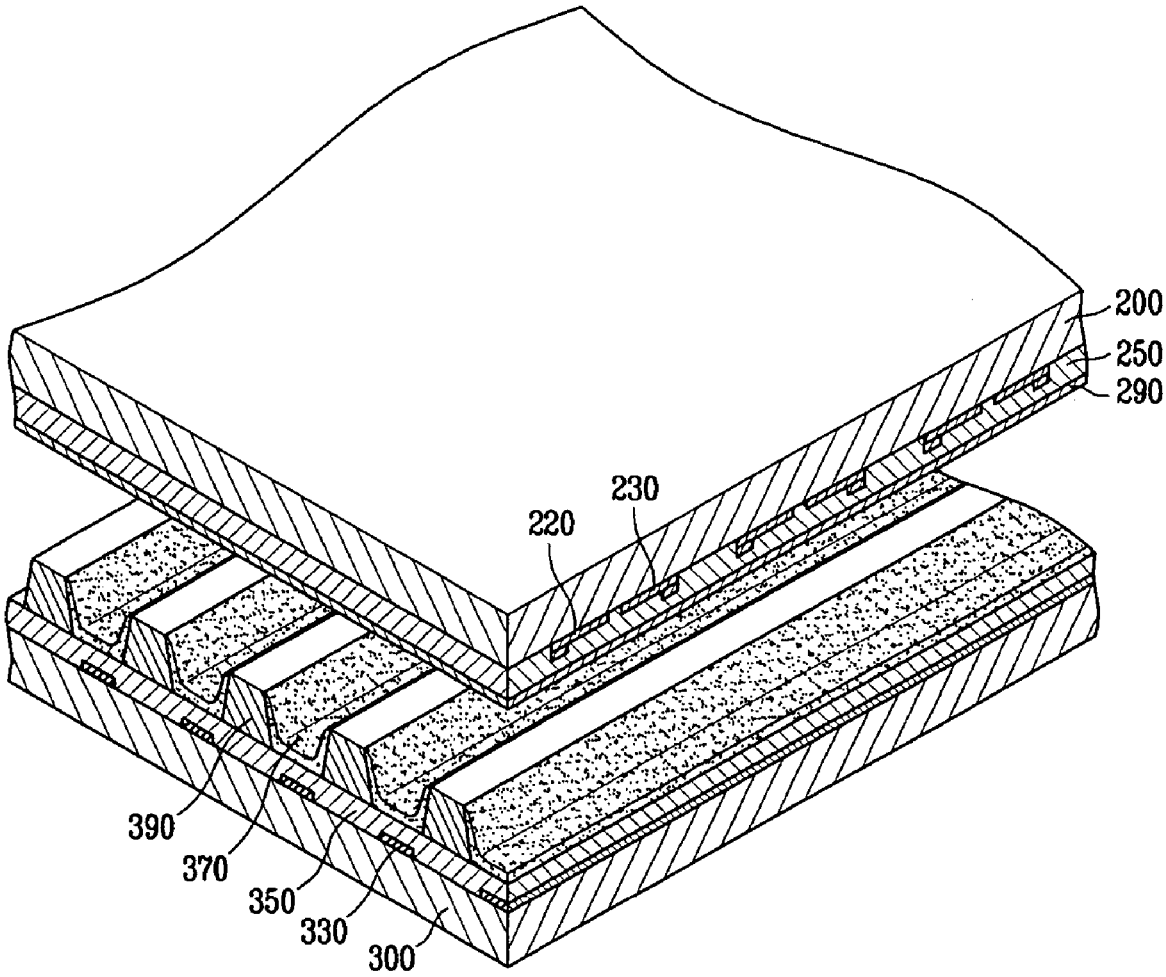
FIG. 1 is a perspective view showing a configuration of a related art three-electrode surface discharge plasma display panel.
Figure 2:
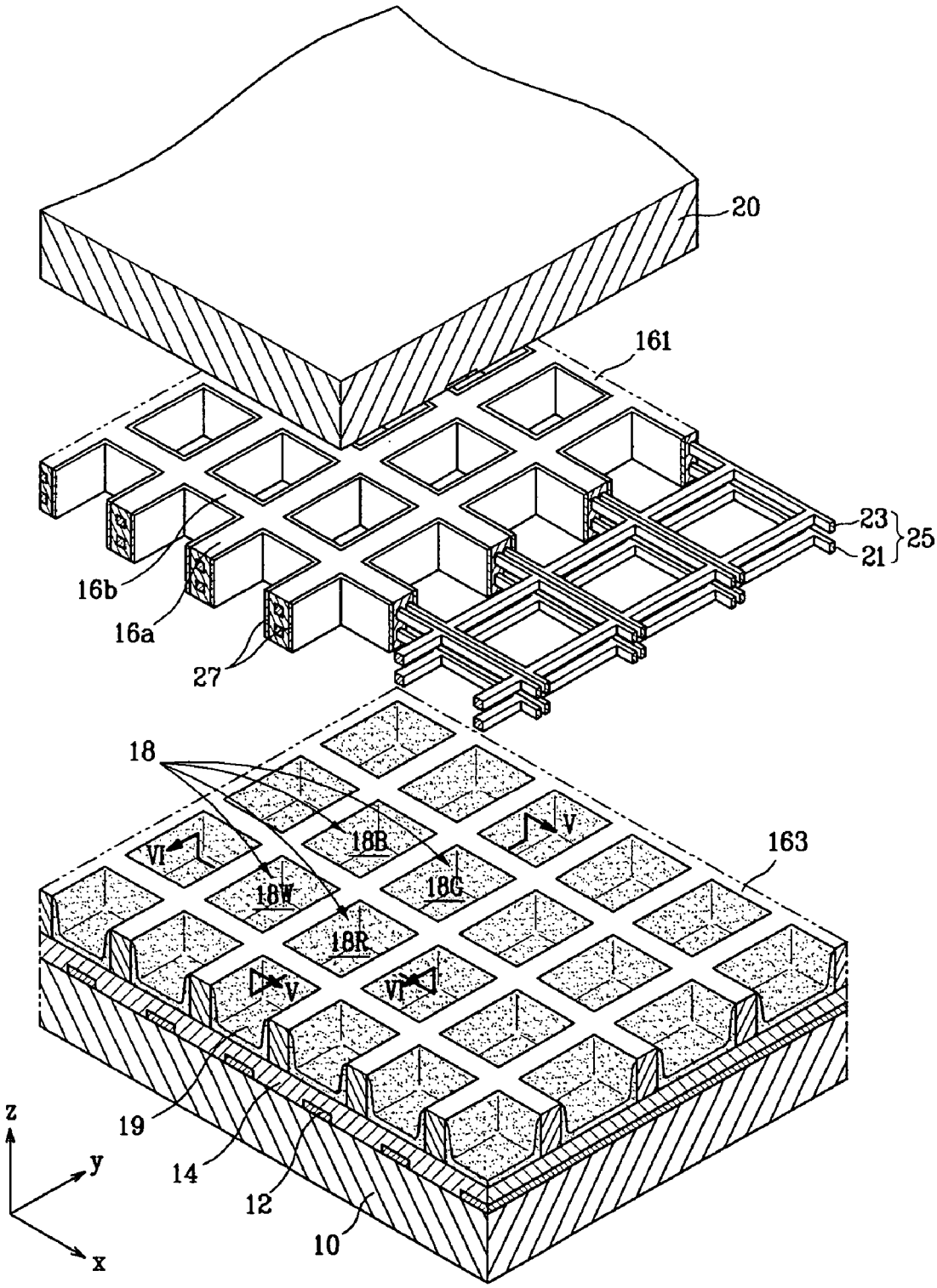
FIG. 2 is an exploded perspective view showing the plasma display panel according to a first embodiment of the present invention.

FIG. 2 is a partially exploded perspective view showing a PDP according to a first embodiment of the present invention. This embodiment includes discharge cells 18 (18R, 18G, 18B, and 18W) that are divided by barrier ribs 161 and 163 between a front substrate 20 and a rear substrate 10. Here, display electrodes 25 are buried in a first barrier rib 161 so as to surround the peripheries of the discharge cells 18.

The front substrate 20 is made of a transparent glass substrate, through which visible light passes, and is disposed to face the rear substrate 10.

Between the front substrate 20 and the rear substrate 10, the first barrier rib 161 is formed. The first barrier rib 161 is formed on the front substrate 20 so as to divide the discharge cells 18. The respective discharge cells 18 constitute the subpixels, each serving as a minimum unit to display an image.

In the present invention, a group of subpixels for red (R), green (G), blue (B), and white (W) constitutes one pixel. A detailed description thereof will be given below.

The display electrodes 25 are formed in the first barrier rib 161 to surround the discharge cells 18. In the present embodiment, each of the display electrodes 25 has a first electrode (hereinafter, referred to as a 'scan electrode') 21 for selecting a discharge cell, together with an address electrode 12, and a second electrode (hereinafter, referred to as a 'sustain electrode') 23 for sustaining a discharge in the selected discharge cell, together with the scan electrode 21.

In the first embodiment, the scan electrode 21 and the sustain electrode 23 are disposed to surround the upper portions of the discharge cells. Here, the upper portion of each of the discharge cells 18 means a portion above (z-axis direction in FIG. 2) the phosphor layers 19 formed on a second barrier rib 163.

The first barrier rib 161 divides the discharge cells 18, which respectively form independent discharge spaces, and are made of a dielectric in order to prevent the scan electrode 21 and the sustain electrode 23 from being electrically connected to each other.

Further, the first barrier rib 161 prevents charged particles from colliding directly against and damaging the display electrodes 25 and induces the charged particles to accumulate wall charges.

Between the first barrier rib 161 and the rear substrate 10, the second barrier rib 163 is formed. In this case, the second barrier rib 163 is disposed between the first barrier rib 161 and the rear substrate 10 to divide the discharge cells 18, together with the first barrier rib 161, and prevent erroneous discharge between the discharge cells 18. Herein, the discharge cells 18 are divided by the combination of the first barrier rib 161 and the second barrier rib 163, but the first barrier rib 161 and the second barrier rib 163 may be integrally formed.

In FIG. 2, the barrier rib 161 has vertical barrier ribs 16*a* that extend in an extension direction (y-axis direction in FIG. 2) of the address electrodes 12 to be spaced from one another, and horizontal barrier ribs 16*b* that extend in a direction crossing the vertical barrier ribs 16*a* (x-axis direction in FIG. 2) to be spaced from one another, such that the discharge cells 18 are formed in a lattice shape. However, the present invention is not limited thereto, and the discharge cells 18 may be divided in various shapes.

The first barrier rib 161, in this embodiment, is covered with a protective film 27. The protective film 27 prevents the first barrier rib 161 from being damaged due to the collision of the charged particles against the first barrier rib 161 and emits secondary electrons at the time of discharge.

Figure 7:
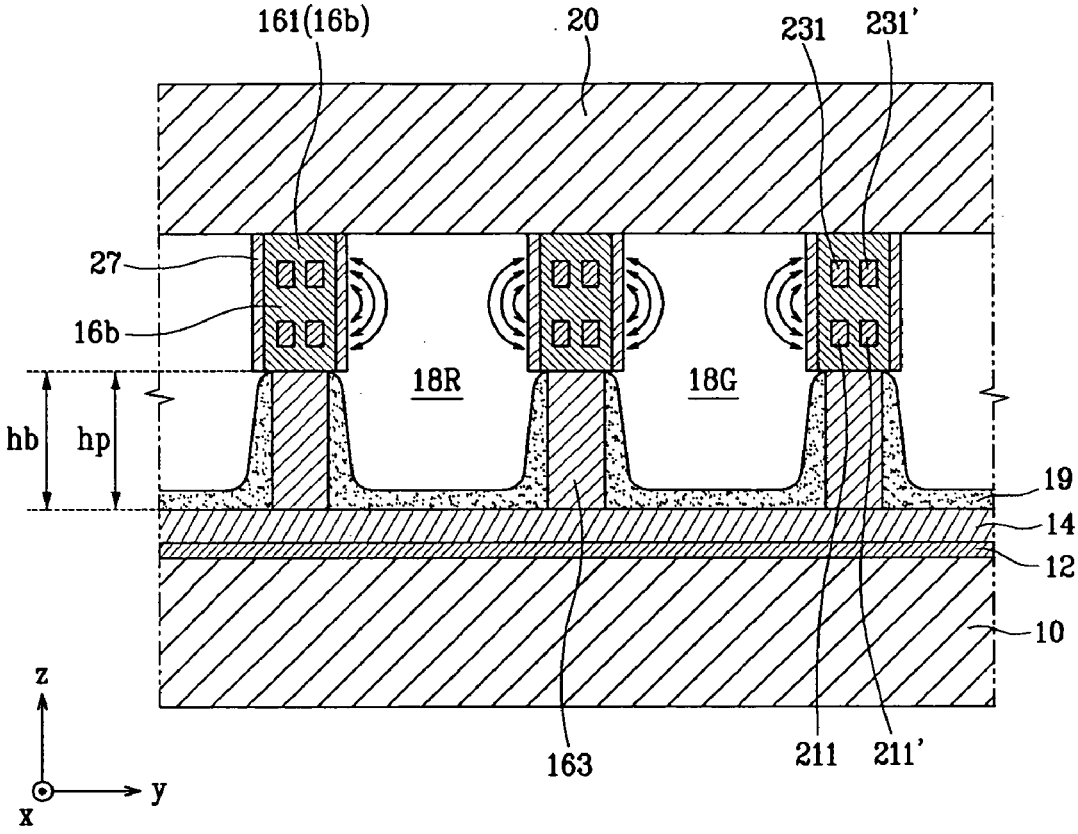
FIG. 7 is a cross-sectional view taken along the line V-V of FIG. 2.

When the second barrier rib 163 is provided to define the discharge cells 18 in addition to the first barrier rib 161, the height hp of each of the phosphor layers 19, in one embodiment, is equal to the height hb of the second barrier rib 163 (see FIG. 7).

Referring again to FIG. 2, the first barrier rib 161 is made of a dielectric in order to cause the discharge to be easily generated, thereby exhibiting a superior memory property. The phosphor layers 19 are formed on the second barrier rib 163, below the first barrier rib 161, in order to cause visible rays to be generated in wider regions.

The second barrier rib 163 is formed on a dielectric layer 14 that is formed on the entire surface of the rear substrate 10. The dielectric layer 14 covers the address electrodes 12 provided at the respective discharge cells 18. The dielectric layer 14 is made of a dielectric in order to prevent the address electrodes 12 from being damaged due to collision of positive ions or electrons against the address electrodes 12 at the time of the discharge, and to induce electric charges. As such, a dielectric, PbO, $B_2O_3$, $SiO_2$, or the like may be used.

Figure 3:
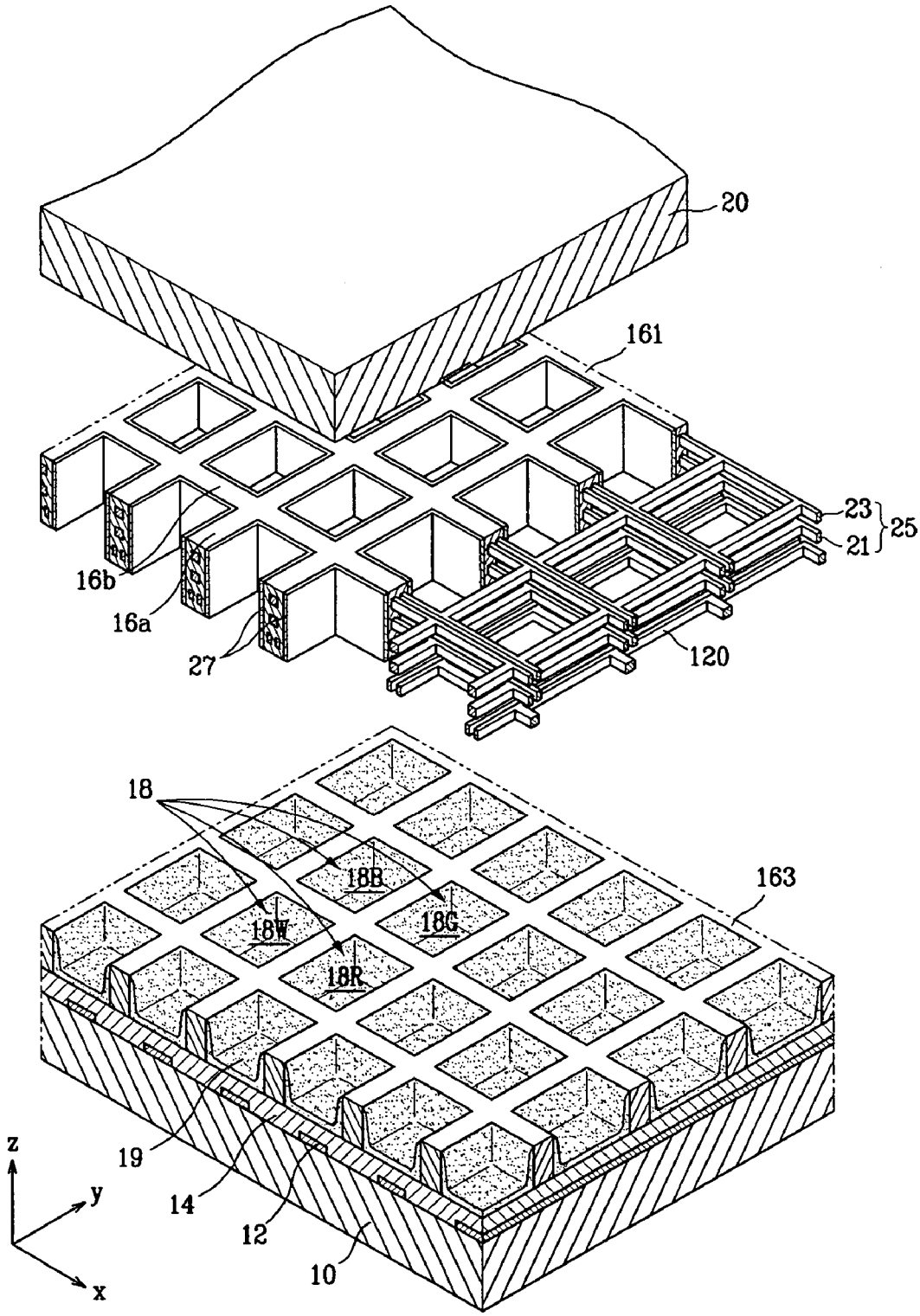
FIG. 3. is an exploded perspective view showing the plasma display panel in the case of an address electrode formed to a front substrate.

The address electrodes 12 are formed on the rear substrate 10 to extend in the y-axis direction across the discharge cells 18. As shown in FIG. 3, the address electrodes 120 may be buried in the barrier rib 161, like the display electrodes 25 described above. In this case, the address electrodes 120 are buried in barrier ribs formed in a direction crossing the scan electrodes 21 (y-axis direction in FIG. 2).

The phosphor layers 19 are formed in the respective discharge cells 18 and are excited by ultraviolet rays generated at the time of the discharge so as to emit visible rays. As shown in FIG. 2, the phosphor layers 19 are formed throughout the wall surfaces of the second barrier rib 163 and bottom surfaces defined by the second barrier rib 163 (see FIGS. 6 and 7).

Each of the phosphor layers 19 is made of one of red, green, blue, and white phosphors for color representation. Accordingly, the phosphor layers 19 are divided into red, green, blue, and white phosphor layers 18R, 18G, 18B, and 18W. As described above, in the respective discharge cells 18 in which the phosphor layers 19 are disposed, a mixed discharge gas of neon (Ne), xenon (Xe), and the like is filled.

Figure 4:
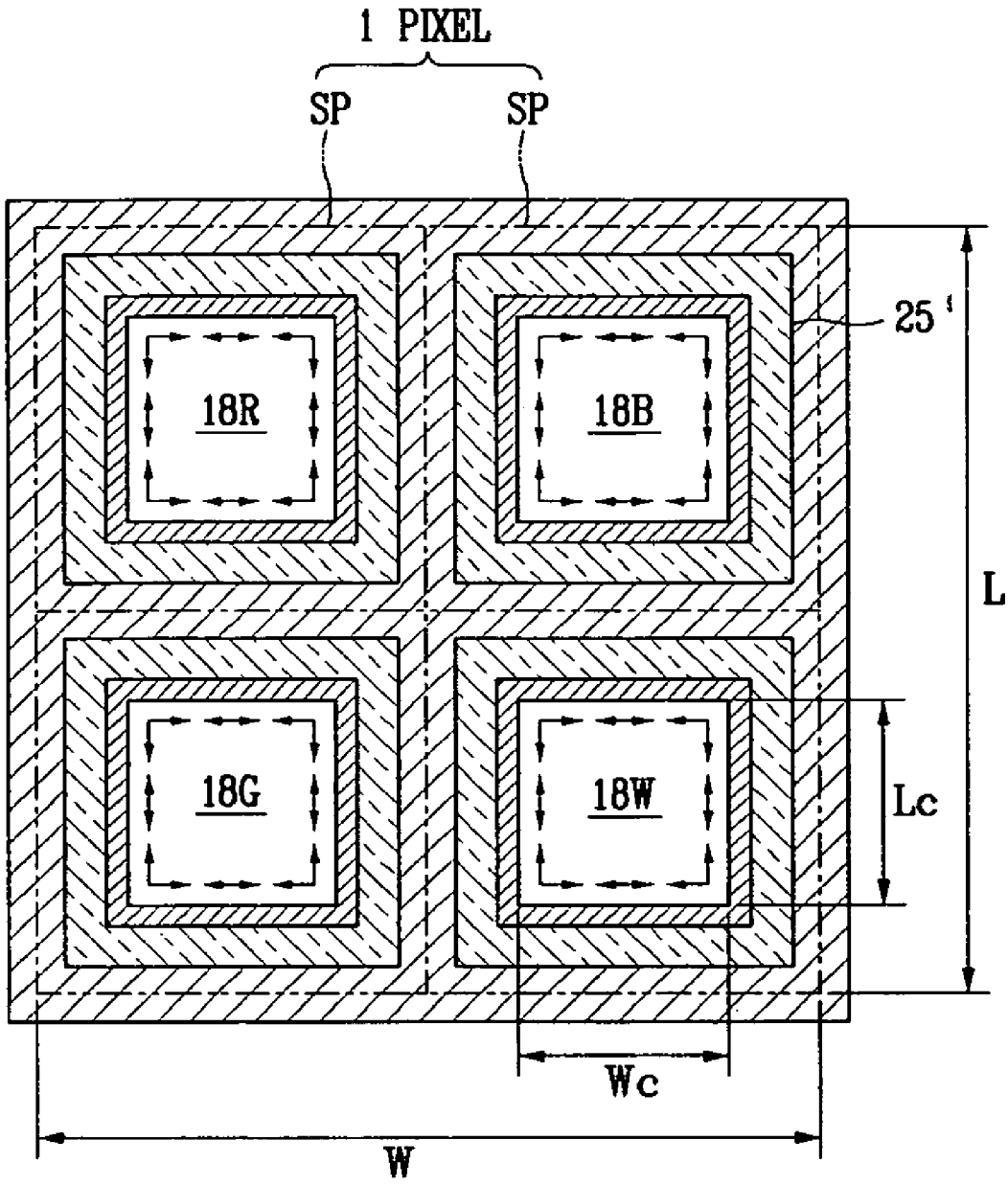
FIG. 4 is a diagram showing an arrangement relationship of subpixels which are formed in one pixel.

Hereinafter, the discharge cell structure according to the present embodiment will be described in detail with reference to FIG. 4. FIG. 4 is a diagram showing the arrangement of the subpixels constituting the pixel, that is, the discharge cells.

In the present embodiment, the discharge cells 18 (18R, 18G, 18B, and 18W) for respective colors includes red discharge cells 18R emitting red light components, blue discharge cells 18B emitting blue light components, green discharge cells 18G emitting green light components, and white discharge cells 18W emitting white light components. In the discharge cells 18 for the respective colors, the phosphors are coated so as to emit corresponding light components at the time of luminescence.

As such, in the present embodiment, the pixel includes four subpixels of red, blue, green, and white. The subpixels for the respective colors are arranged in a 2×2 matrix.

As described above, in the PDP of the present embodiment, the white discharge cells 18W are included in the pixels, and thus white purity of an image can be improved and colors can be precisely represented.

Further, in the present embodiment, the discharge cells are arranged in the 2×2 matrix to constitute one pixel. Therefore, four subpixels SP are geometrically arranged in a substantially square shape, in which the horizontal length W or Wc and the vertical length L or Lc are equal to each other.

In the present embodiment, since the display electrodes 25 are formed to surround the respective discharge cells 18, each of the discharge cells 18 are geometrically point-symmetric with respect to its center. By doing so, the discharge can be used throughout the discharge cell.

For example, when the display electrode 25 is provided at the wall surfaces of each of the discharge cells, if the vertical length is larger than the horizontal length in the discharge cell having a rectangular shape in a plan view, an electric field generated by the display electrode in the vertical direction is larger than that in the horizontal direction. Thus, plasma is generated only in the vertical direction. Accordingly, there may be a problem in that the discharge cell cannot be used throughout and light is emitted only by a portion of the discharge cell.

Like the present embodiment, when the discharge cells are arranged in the 2×2 matrix, the respective discharge cells can be formed in a square shape in which the horizontal length and the vertical length are equal to each other, such that the discharge cell can be used throughout.

Figure 5:
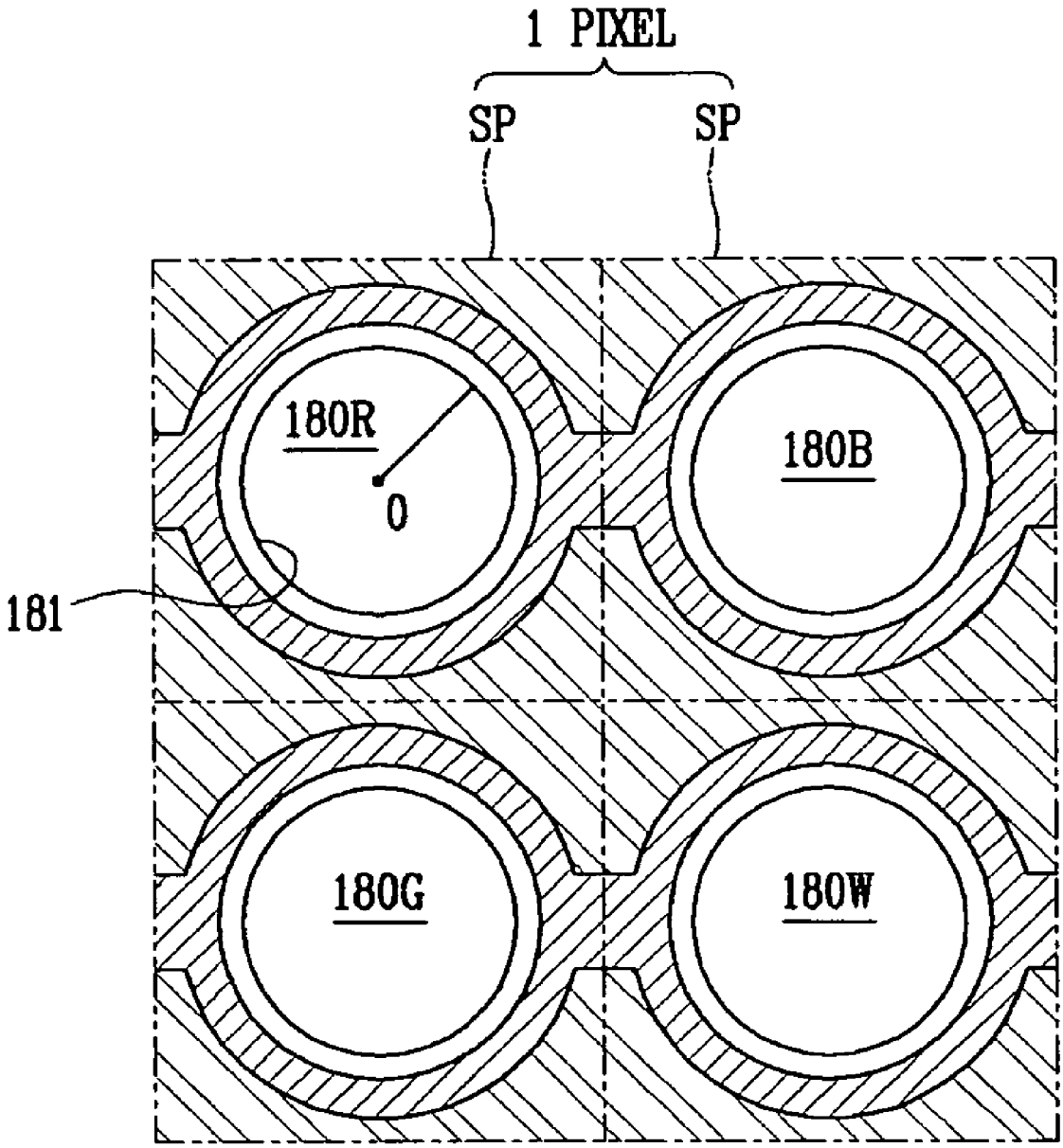
FIG. 5 is a diagram showing discharge cells formed to a circular plane shape and an arrangement relationship of subpixels which are formed in one pixel.

As shown in FIG. 5, each of the discharge cells 180R, 180G, 180B, 180W may be formed with a circular plane shape, and each of the discharge cells 180R, 180G, 180B, 180W is arranged in the 2×2 matrix to constitute one pixel. In this case, as the center O of each discharge cell has a constant distance r from the wall of the barrier rib 181, the discharging begun at the wall of the barrier rib is uniformly diffused to the center O.

Figure 6:
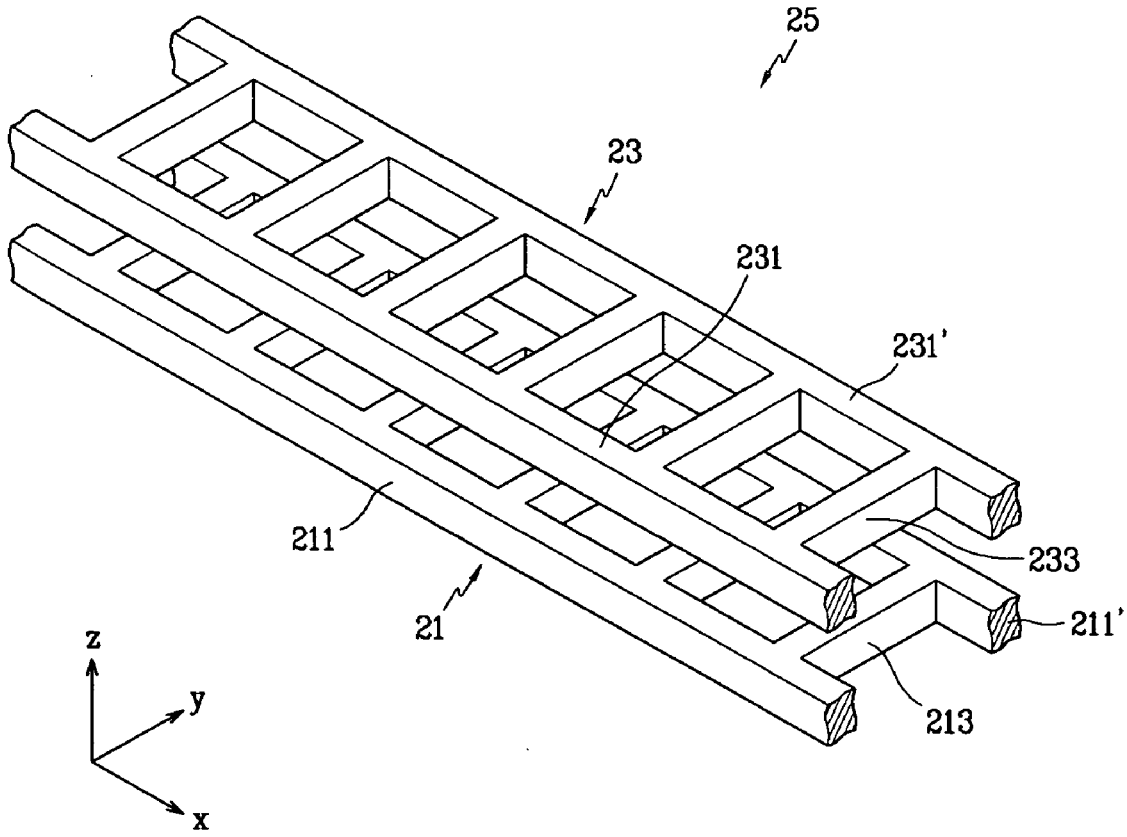
FIG. 6 is a perspective view showing a display electrode according to the first embodiment of the present invention.
Figure 8:
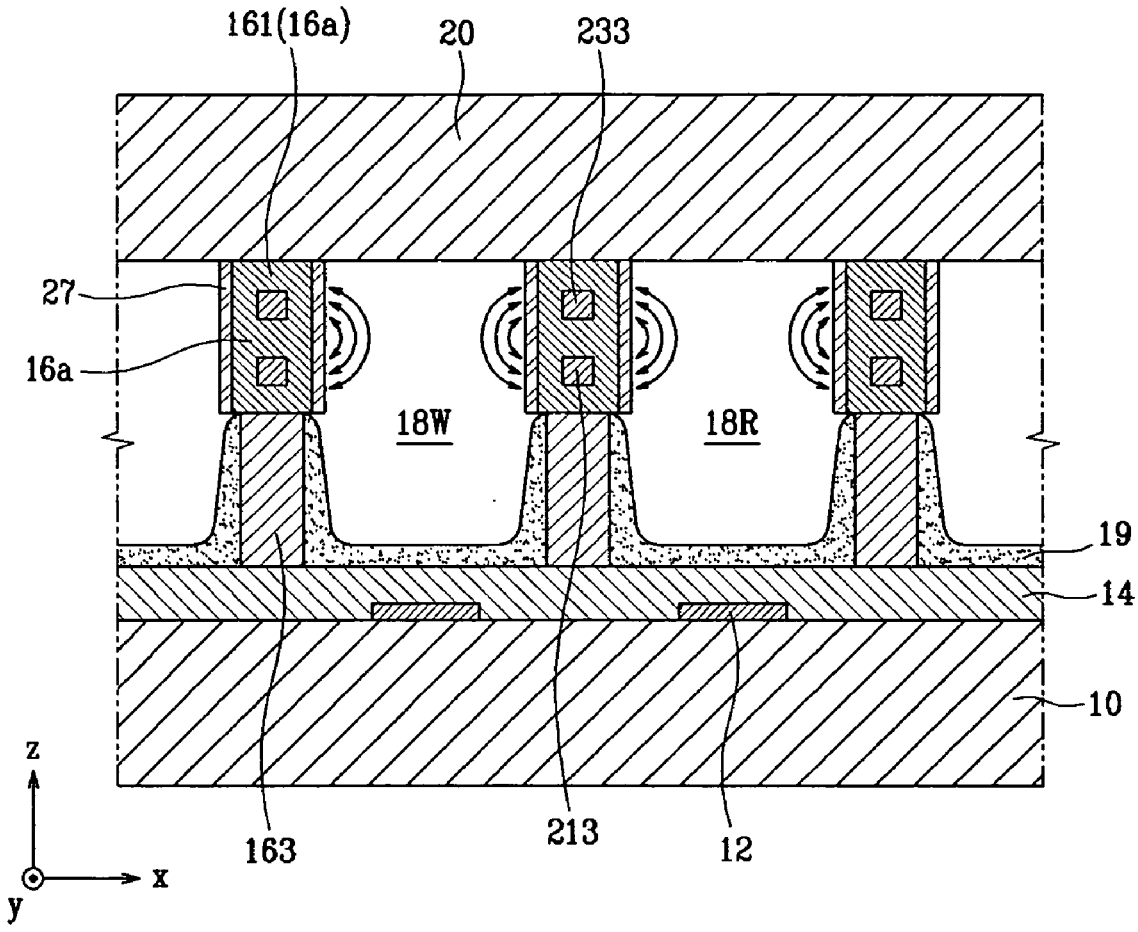
FIG. 8 is a cross-sectional view taken along the line VI-VI of FIG. 2.

Hereinafter, the display electrode of the first embodiment provided with respect to the discharge cells formed in such a manner will be described in detail with reference to FIGS. 6 to 8. FIG. 6 is a perspective view showing the display electrode according to the first embodiment of the present invention, FIG. 7 is a cross-sectional view taken along the line V-V of FIG. 2, and FIG. 8 is a cross-sectional view taken along the line VI-VI of FIG. 2.

In the first embodiment, the sustain electrode 23 and the scan electrode 21 are sequentially buried in the first barrier rib 161 from the front substrate 20 toward the rear substrate 10, such that the display electrode 25 is formed. As such, the scan electrode 21 is formed to be closer to the address electrode 12 than is the sustain electrode 23, and thus a discharge voltage of an address discharge for selecting a discharge cell to be turned on between the scan electrode 21 and the address electrode 12 is reduced, as compared to the related art, thereby realizing low-voltage driving.

The sustain electrode 23 is formed to be buried in the first barrier rib 161 on the front substrate 20 and the scan electrode 21 is formed below the sustain electrode 23 while being electrically isolated therefrom. Here, the sustain electrode 23 and the scan electrode 21 are formed to have the same structure, and thus the description of the scan electrode 21 may be substituted with the description of the sustain electrode 23.

In the first embodiment, the sustain electrode 23 has a pair of line electrodes 231 and 231' that extend in the extension direction of the horizontal barrier ribs 16*b* (x-axis direction in the drawing), and connection electrodes 233 that connect the pair of line electrodes 231 and 231'. Accordingly, the sustain electrode 23 of the first embodiment has a ladder shape.

The sustain electrode 23 having such a shape is disposed in the barrier rib which is disposed just below the front substrate 20, from the barrier rib 161.

The line electrodes 231 and 231' are buried in the vertical barrier ribs 16*b* and are disposed to extend in the extension direction of the vertical barrier ribs 16*a* (see FIG. 7).

The connection electrodes 233 are disposed in the horizontal barrier ribs 16*a*, such that the sustain electrode 23 substantially surrounds the peripheries of the discharge cells 18 (see FIG. 8).

Similarly, the scan electrode 21 is disposed just below the sustain electrode 23 to have the same shape as that of the sustain electrode 23.

Accordingly, the sustain electrode 23 and the scan electrode 21 are disposed to face each other at the same wall surface along the periphery of the discharge cell.

As such, the display electrode 25 of the present embodiment is disposed at the side surface of the discharge space, not at the front substrate 20 through which visible rays pass. Therefore, a transparent electrode having large resistance does not need be used as the display electrode 25. That is, an electrode (for example, a metal electrode) having low resistance can be used as the display electrode 25. Accordingly, in the PDP of the first embodiment, a discharge response speed is fast, and thus low-voltage driving can be realized with no waveform distortion.

Hereinafter, in the PDP of the first embodiment, the discharge phenomenon in the sustain discharge period according to a general driving method using memory characteristics will be described with reference to FIGS. 7 and 8.

If a driving voltage is applied between the address electrode 12 and the scan electrode 21, a discharge cell 18 to be discharged is selected and wall charges are accumulated on the scan electrode 21 of the selected discharge cell 18.

Next, if a positive (+) voltage is applied to the sustain electrode 23 and a voltage relatively lower than the positive voltage is applied to the scan electrode 21, the wall charges travel in an opposite direction by the difference in voltage between the scan electrode 21 and the sustain electrode 23. The traveling wall charges collide against a discharge gas in the discharge cell 18 to cause the discharge and to generate plasma. At this time, there is a high possibility that such a discharge may be generated from a portion at which the sustain electrode 23 and the scan electrode 21 are close to each other and thus a relatively intensive electric field is formed.

In the present embodiment, the sustain electrode 23 and the scan electrode 21 face each other along the periphery of the discharge cell 18, and thus the possibility that the discharge may be generated is drastically increased, as compared to the related art in which the display electrode 25 is disposed only on the upper side of the discharge cell.

If the difference in voltage between two electrodes 21 and 23 is maintained at a sufficiently large level even when time passes, the electric field formed between the surfaces of two electrodes 21 and 23 is condensed intensively more and more, such that the discharge is diffused throughout the discharge cell 18.

In the first embodiment, the discharge is generated in a ring shape from four surfaces of the discharge cell 18 to be diffused to its center. On the other hand, in the related art, the discharge is generated at the upper side of the discharge cell to be diffused to its central portion. Therefore, in the present embodiment, the diffusion range of the discharge is drastically increased, as compared to the discharge in the related art.

Further, in the present embodiment, plasma generated by the discharge is formed in a ring shape along the wall surfaces of the discharge cell 18 and is diffused to the center of the discharge cell 18, and thus the volume of plasma is drastically increased and the amount of visible rays is also drastically increased. As plasma is condensed into the central portion of the discharge cell 18, spatial charges can be utilized, such that low-voltage driving can be realized and luminous efficiency can be enhanced.

Further, in the first embodiment, plasma is condensed into the center of the discharge cell 18 and the electric field by the display electrode 25 is formed on both sides of the plasma. Therefore, electric charges are condensed into the center of the discharge cell 18, thereby preventing ion sputtering to the phosphor by the electric charges.

Figure 9:
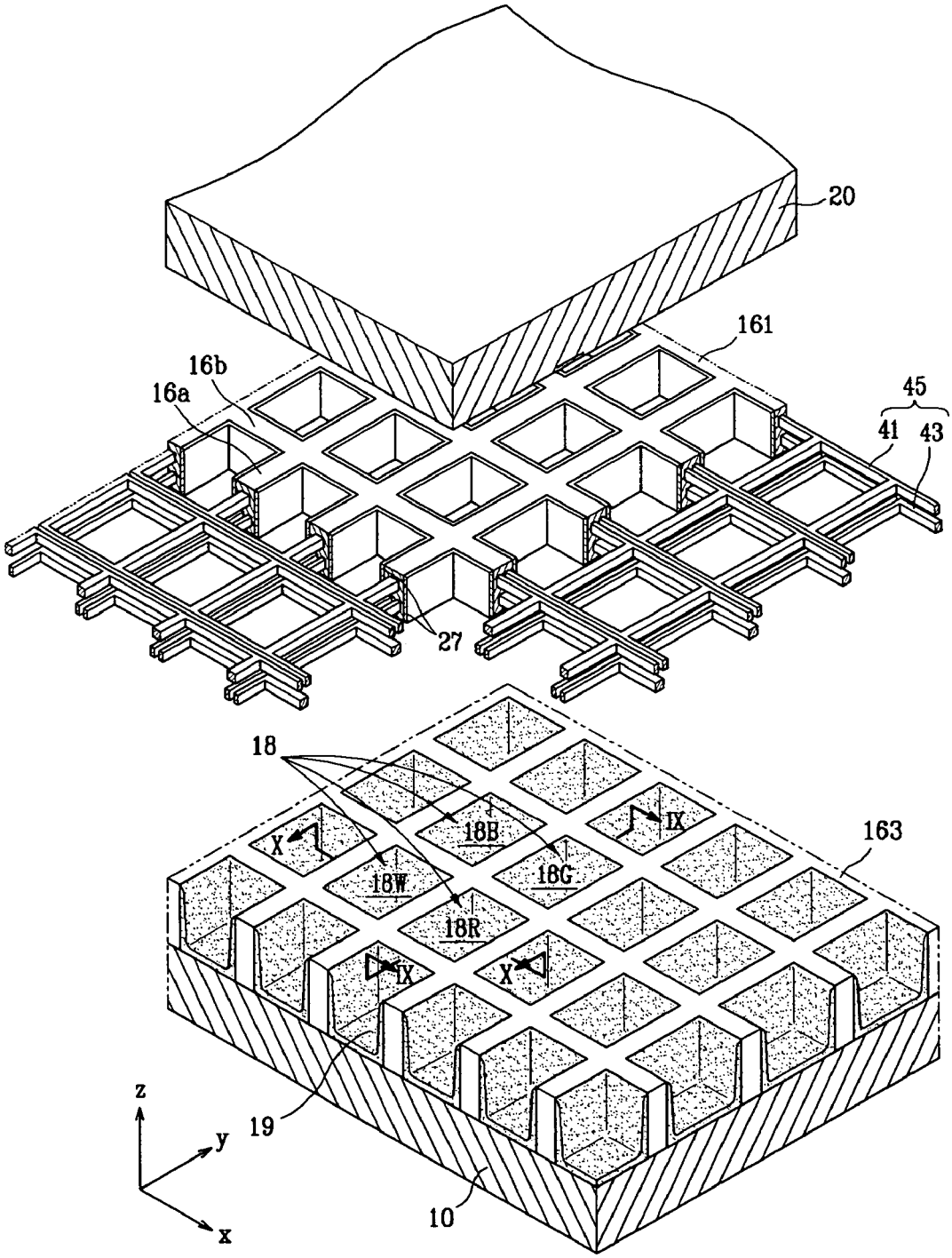
FIG. 9 is an exploded perspective view showing a plasma display panel according to a second embodiment of the present invention.

Hereinafter, a PDP according to a second embodiment of the present invention will be described. In the following description, the same elements as those in the first embodiment are represented by the same reference numerals and thus descriptions thereof will be omitted. FIG. 9 is a partially exploded perspective view schematically showing the PDP according to the second embodiment of the present invention.

The PDP of the present embodiment has the discharge cells 18 (18R, 18G, 18B, and 18W) divided by the barrier rib 16 between the front substrate 20 and the rear substrate 10 that face each other. Display electrodes 45 are formed to surround the peripheries of the discharge cells 18.

Each of the display electrodes 45 has a sustain electrode 41 for selecting a discharge cell 18 and sustaining the discharge, and a scan electrode 43 for selecting the discharge cell 18 together with the sustain electrode 41.

The sustain electrode 41 and the scan electrode 43 are formed to be buried in the first barrier rib 161 and to be sequentially disposed in a direction from the front substrate 20 toward the rear substrate 10 (or vice versa).

In the second embodiment, the address electrodes 12 are not provided on the rear substrate 10, unlike the first embodiment.

For this reason, the dielectric layer for protecting the address electrodes 12 is not formed selectively, such that the amount of the phosphor to be coated on the discharge cell 18 can be further increased.

Phosphors of four colors of red (R), green (G), blue (B), and white (W) are coated in the discharge cells 18 to form the subpixels, and the subpixels are arranged in the 2×2 matrix to constitute one pixel.

In the PDP of the second embodiment, the address electrodes do not exist, and thus the sustain electrode 41 and the scan electrode 43 are formed to cross each other. For example, when the sustain electrode 41 is formed to extend in the x-axis direction of the drawing, the scan electrode 43 is formed to extend in the y-axis direction of the drawing.

Figure 10:
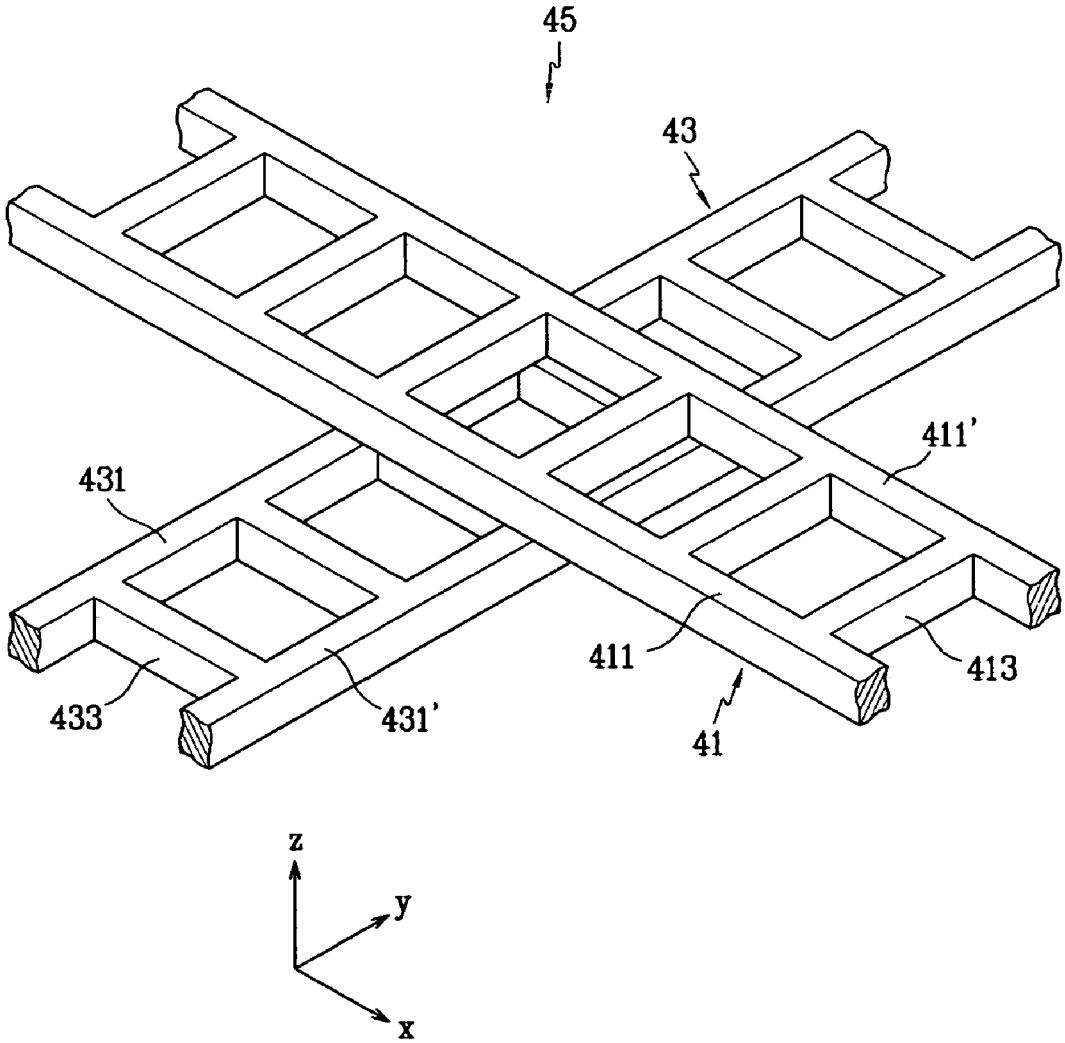
FIG. 10 is a perspective view showing a display electrode according to the second embodiment of the present invention.

FIG. 10 shows the display electrode 45 of the second embodiment. Referring to FIG. 10, the sustain electrode 41 has a pair of line electrodes 411 and 411' and connection electrodes 413 that connect the line electrodes 411 and 411'.

The line electrodes 411 and 411' are formed in slender and long linear shapes and extend in the x-axis direction of the drawing. The line electrodes 411 and 411' face each other.

The connection electrodes 413 extend in a direction crossing the line electrodes so as to connect the pair of line electrodes 411 and 411'.

The line electrodes 411 and 411' are buried in the horizontal barrier ribs 16*b* and the connection electrodes 413 are buried in the vertical barrier ribs 16*a*, so as to surround the discharge cells 18 in ring shapes.

In the second embodiment, the scan electrode 43 is formed to cross the sustain electrode 41.

Therefore, as shown in FIG. 10, the scan electrode 43 has a pair of line electrodes 431 and 431' and connection electrodes 433 connecting the pair of line electrodes 431 and 431'. Here, the line electrodes 431 and 431' are formed to extend in the y-axis direction of the drawing. Then, the connection electrodes 433 extend in a direction crossing the line electrodes 431 and 431' (x-axis direction in the drawing) so as to connect the line electrodes 431 and 431'.

Accordingly, the scan electrode 43 and the sustain electrode 41 are formed to substantially cross each other.

Of the scan electrode 43 formed to cross the sustain electrode 41 in such a manner, the line electrodes 431 and 431' are buried in the vertical barrier ribs 16*a* and the connection electrodes 433 are buried in the horizontal barrier ribs 16*b*, so as to surround the discharge cells 18 in ring shapes.

Figure 11:
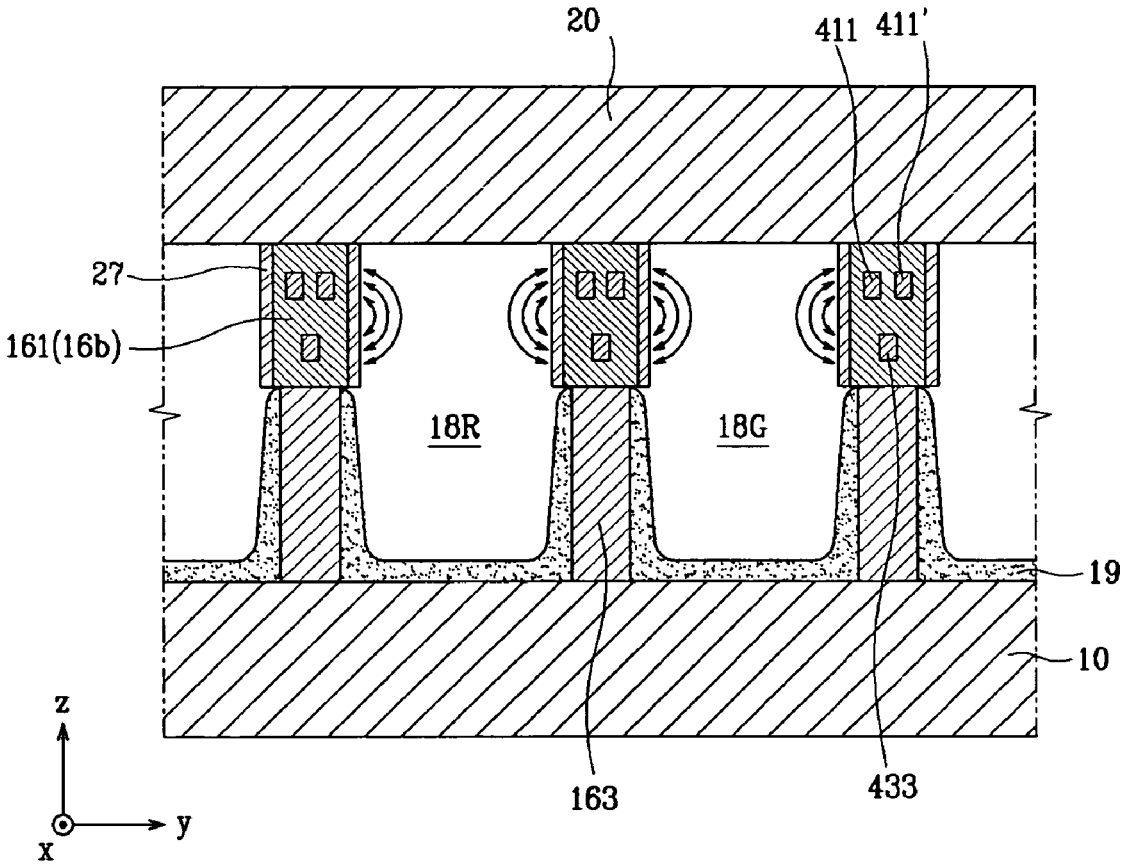
FIG. 11 is a cross-sectional view taken along the line IX-IX of FIG. 9.
Figure 12:
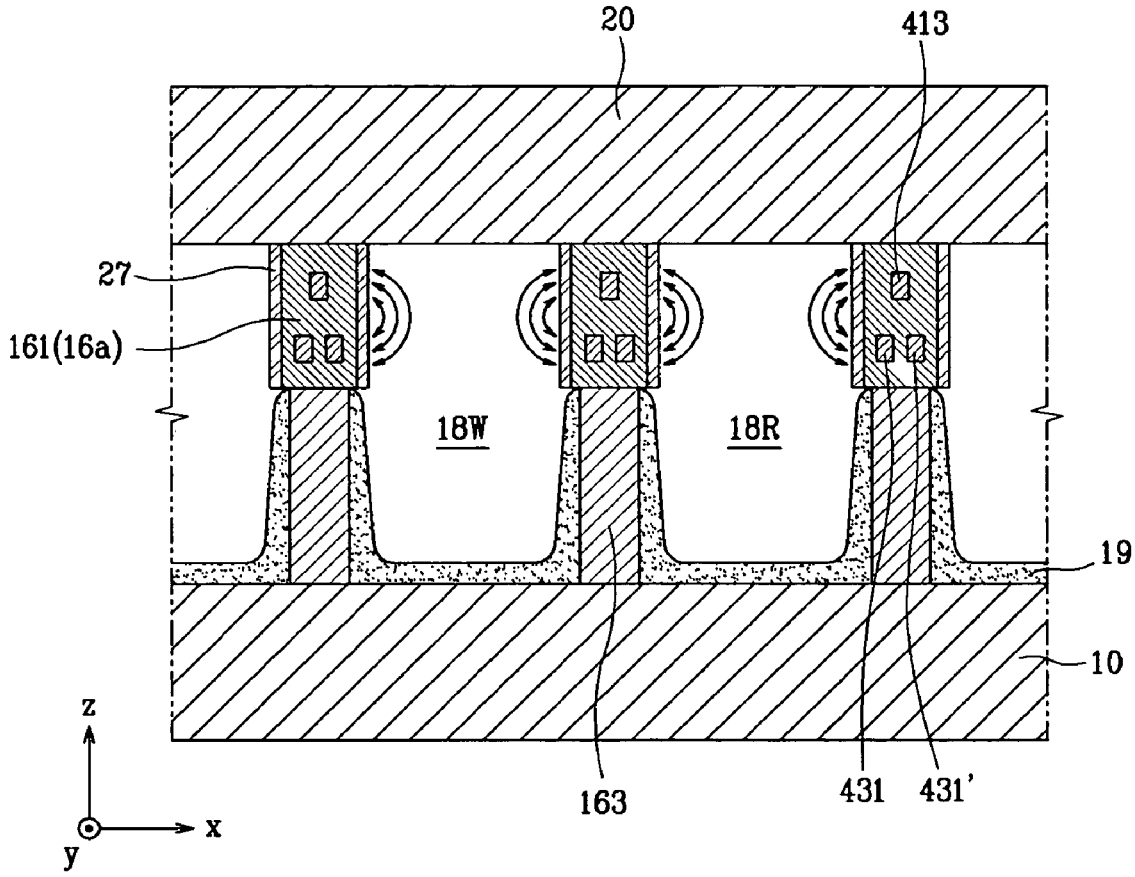
FIG. 12 is a cross-sectional view taken along the line X-X of FIG. 9.

Accordingly in the display electrode 45 of the second embodiment, the sustain electrode 41 and the scan electrode 43 vertically face each other along the z-direction of the barrier rib 16. Hereinafter, in the PDP of the second embodiment, the discharge phenomenon in the sustain discharge period according to the general driving method using memory characteristics will be described with reference to FIGS. 11 and 12.

If a driving voltage is applied between the sustain electrode 41 and the scan electrode 43, a discharge cell 18 to be discharged is selected and wall charges are accumulated on the sustain electrode 41 of the selected discharge cell 18.

Next, if a positive (+) voltage is applied to the sustain electrode 41 and a voltage relatively lower than the positive voltage is applied to the scan electrode 43, the wall charges travel in an opposite direction by the difference in voltage between the sustain electrode 41 and the scan electrode 43. The traveling wall charges collide against a discharge gas in the discharge cell 18 to cause the discharge and to generate plasma. At this time, there is a high possibility that such a discharge may be generated from a portion at which the sustain electrode 41 and the scan electrode 43 are close to each other and thus a relatively intensive electric field is formed.

In the present embodiment, the sustain electrode 41 and the scan electrode 43 face each other along the periphery of the discharge cell 18, and thus the possibility that the discharge may be generated is drastically increased, as compared to the related art in which the display electrode 45 is disposed only on the upper side of the discharge cell.

If the difference in voltage between two electrodes 41 and 43 is maintained at a sufficiently large level even when time passes, the electric field formed between the surfaces of two electrodes 41 and 43 is condensed intensively more and more, such that the discharge is diffused throughout the discharge cell 18.

According to the present embodiment, on the front substrate through which visible rays pass to display an image, other parts are not provided, and thus an aperture ratio can be drastically enhanced.

Further, in the PDP of the present embodiment, the shapes of the discharge cell in the horizontal and vertical directions are symmetric, and thus the discharge region can be uniformly expanded and the electric field can be condensed into the center thereof, thereby improving luminance efficiency.

Further, in the PDP of the present embodiment, the discharge is generated at the side surfaces which define the discharge space, and is diffused to the central portion of the discharge space. Therefore, the volume and amount of plasma by the discharge are drastically increased, thereby improving luminous efficiency.

Further, in the PDP of the present embodiment, the discharge is generated at the side surfaces which define the discharge space, and is diffused to the center of the discharge space, and thus plasma is condensed into the central portion of the discharge space. That is, plasma is condensed into the central portion of the discharge space due to the electric field caused by the voltage applied to the discharge electrode formed at the side surface, such that spatial charges can be used for the discharge.

Further, in the PDP of the present embodiment, the electrodes are provided to face each other in the barrier ribs, and thus the interval between the electrodes can be reduced and the discharge voltage can be drastically reduced. Therefore, low-voltage driving can be realized, such that luminous efficiency can be drastically enhanced.

In this embodiment, in order to increase luminous efficiency, Xe gas in a high concentration may used as the discharge gas. In this case, low-voltage driving is difficult to realize. On the contrary, in the PDP of the embodiments described above, low-voltage driving can be realized, and thus even when the Xe gas in the high concentration is used as the discharge gas, low-voltage driving can be realized, thereby enhancing luminance efficiency.

Further, in the PDP of the present embodiment, the discharge response speed is fast and low-voltage driving is possible. The display electrode is disposed at the side surfaces of the discharge space, not on the front substrate through which visible rays pass. Therefore, the transparent electrode having a large resistance does not need to be used as the display electrode. That is, the electrode having low resistance, for example the metal electrode, may be used as the display electrode. As a result, the discharge response speed can be made fast and low-voltage driving can be realized with no waveform distortion.

Further, in the PDP of the present embodiment, a permanent afterimage can be prevented. Plasma is condensed into the central portion of the discharge space due to the electric field caused by the voltage applied to the discharge electrode formed at the side surface of the discharge space. Therefore, even when the discharge is maintained for a long time, ions generated by the discharge are prevented from colliding against the phosphor due to the electric field and thus the permanent afterimage due to the damage of the phosphor caused by ion sputtering can be prevented. In particular, when the Xe gas with a high concentration is used as the discharge gas, the permanent afterimage may be serious, but, in the present embodiment, the permanent afterimage can be prevented.

Further, in the PDP of the present embodiment, the discharge cells including the white discharge cell are arranged in the 2×2 matrix to constitute one pixel, and thus the discharge cells constituting the subpixels can be easily formed to be geometrically symmetric. Further, since the white discharge cell is included, the color representation can be performed more clearly according to the digital signals.

In addition, in the PDP of the present invention, since the white discharge cell is included, in order to represent white, all the red, green, and blue discharge cells do not need to be selected, unlike the related art. That is, in order to represent white, only the white discharge cell is selected. Therefore, power consumption according to driving of the discharge cell can be reduced.

Although a various embodiments of the present invention have been described in detail hereinabove, it should be understood that variations and/or modifications of the basic inventive concept taught herein will still fall within the spirit and scope of the present invention, as defined in the appended claims and their equivalents.

What is claimed is:

1. A plasma display panel comprising:

first and second substrates facing each other;

a barrier rib structured between the first and second substrates to divide a plurality of discharge cells;

first and second electrodes surrounding the discharge cells and extending in a first direction, the first and second electrodes being buried in the barrier rib structure;

address electrodes extending in a second direction crossing the first direction and corresponding to the discharge cells; and phosphor layers in the discharge cells, such that the discharge cells are divided into red, green, blue, and white discharge cells.

2. The plasma display panel of claim 1, wherein at least one pixel of the plasma display panel comprises a 2×2 matrix of the red, green, blue, and white discharge cells.

3. The plasma display panel of claim 1, wherein the barrier rib structure comprises a dielectric.

4. The plasma display panel of claim 1, wherein cross-sections of the discharge cells are substantially geometrically point-symmetric about their centers.

5. The plasma display panel of claim 1, wherein the barrier rib divides the discharge cell into a circular plane shape.

6. The plasma display panel of claim 1, wherein the first and second electrodes are linearly disposed from the first substrate to the second substrate, and the second electrodes select which of the discharge cells are to be turned on, together with the address electrodes.

7. The plasma display panel of claim 1, wherein the barrier rib structure comprises a first barrier rib that is located proximate to the first substrate and a second barrier rib that is located proximate to the second substrate.

8. The plasma display panel of claim 7, wherein the first and second electrodes are buried in the first barrier rib.

9. The plasma display panel of claim 8, wherein the phosphor layers are proximate to the second barrier rib.

10. The plasma display panel of claim 1, wherein the barrier rib structure has vertical barrier ribs extending in the second direction and horizontal barrier ribs extending in the first direction crossing the second direction, and the first and second electrodes comprise line electrodes extending in the first direction and being buried in a pair of the horizontal barrier ribs, and connection electrodes connecting the line electrodes and being buried in the vertical barrier ribs.

11. The plasma display panel of claim 1, wherein the address electrodes are buried in the barrier rib structure.

12. The plasma display panel of claim 11, wherein the second electrodes select which of the discharge cells are to be turned on, together with the address electrodes, and the address electrodes are proximate to the second electrodes.

13. A plasma display panel comprising:

first and second substrates facing each other;

a barrier rib structure between the first and second substrates to divide a plurality of discharge cells;

first and second electrodes surrounding the discharge cells and extending in a first direction and in a second direction crossing the first direction, the first and second electrodes being buried in the barrier rib structure; and phosphor layers in the discharge cells, such that the discharge cells are divided into red, green, blue, and white discharge cells.

14. The plasma display panel of claim 13, wherein at least one pixel of the plasma display panel comprises a 2×2 matrix of the red, green, blue, and white discharge cells.

15. The plasma display panel of claim 13, wherein the barrier rib structure comprises a dielectric.

16. The plasma display panel of claim 13, wherein cross-sections of the discharge cells are geometrically point-symmetric around their centers.

17. The plasma display panel of claim 13, wherein the barrier rib divides the discharge cell into a circular plane shape.

18. The plasma display panel of claim 13, wherein the barrier rib structure comprises a first barrier rib on the first substrate and a second barrier rib on the second substrate.

19. The plasma display panel of claim 18, wherein the first and second electrodes are buried in the first barrier rib.

20. The plasma display panel of claim 19, wherein the phosphor layers are proximate to the second barrier rib.

21. The plasma display panel of claim 13, wherein:

the barrier rib structure comprises vertical barrier ribs extending in the second direction and horizontal barrier ribs extending in the first direction crossing the second direction;

the first electrodes comprise first line electrodes extending in the first direction and being buried in a pair of the horizontal barrier ribs, and first connection electrodes connecting the first line electrodes and being buried in the vertical barrier ribs; and the second electrodes comprise second line electrodes extending in the second direction and being buried in a pair of vertical barrier ribs, and second connection electrodes connecting the second line electrodes and being buried in the horizontal barrier ribs.

* * * * *

UNITED STATES PATENT AND TRADEMARK OFFICE

CERTIFICATE OF CORRECTION

PATENT NO. : 7,408,301 B2
APPLICATION NO. : 11/326167
DATED : August 5, 2008
INVENTOR(S) : Jae-Ik Kwon, Won-Ju Yi and Kyoung-Doo Kang It is certified that error appears in the above-identified patent and that said Letters Patent is hereby corrected as shown below:

| | |
|---|---|
| Column 10, line 57, Claim 1 | Delete "structured",<br>Insert --structure-- |

Signed and Sealed this

Tenth Day of February, 2009

JOHN DOLL
*Acting Director of the United States Patent and Trademark Office*